US008571427B2

(12) United States Patent
Ishii

(10) Patent No.: US 8,571,427 B2
(45) Date of Patent: Oct. 29, 2013

(54) IMAGE OUTPUT DEVICE, IMAGE OUTPUT METHOD, AND COMPUTER PROGRAM PRODUCT

(75) Inventor: Hiroshi Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 383 days.

(21) Appl. No.: 12/926,882

(22) Filed: Dec. 15, 2010

(65) Prior Publication Data

US 2011/0158667 A1 Jun. 30, 2011

(30) Foreign Application Priority Data

Dec. 25, 2009 (JP) ..... 2009-295338
Nov. 29, 2010 (JP) ..... 2010-265461

(51) Int. Cl.
*G03G 15/00* (2006.01)

(52) U.S. Cl.
USPC ..... 399/49

(58) Field of Classification Search
USPC ..... 399/29, 30, 49, 79
See application file for complete search history.

(56) References Cited

U.S. PATENT DOCUMENTS 5,075,725 A * 12/1991 Rushing et al. ..... 399/11
6,556,707 B1 4/2003 Yagishita et al.
7,088,472 B1 8/2006 Okubo et al.
7,760,400 B2 7/2010 Ishii et al.
2004/0096231 A1* 5/2004 Furno et al. ..... 399/49
2004/0257622 A1 12/2004 Shibaki et al.
2005/0169651 A1* 8/2005 Yamada ..... 399/49
2006/0077466 A1 4/2006 Ishii et al.
2007/0127837 A1 6/2007 Ishii
2010/0118347 A1 5/2010 Ishii
2010/0309498 A1 12/2010 Ishii

FOREIGN PATENT DOCUMENTS

JP 3241986 A 7/1997
JP 2000-103147 A 4/2000
JP 2008-040382 A 2/2008
JP 2008-209436 A 9/2008
JP 2009-038734 A 2/2009

OTHER PUBLICATIONS

English language abstract for JP-09-186900 which corresponds to JP-3241986-A.

* cited by examiner

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

An image output device includes a storage unit, an input unit, a layout deriving unit, and an output unit. The storage unit preliminarily stores therein an optimum interval of a plurality of the same color and tone patches formed on a sheet at which an average density value of the patches is stabilized. The input unit receives an input of a condition for arrangement of the patches from a user. The layout deriving unit determines arrangement of the patches on the sheet on the basis of the input condition for arrangement and the optimum interval. The output unit outputs the patches onto the sheet in the determined arrangement.

10 Claims, 12 Drawing Sheets

| PATCH | TONE LEVEL |
|---|---|
| K00 | 0 |
| K01 | 16 |
| K02 | 32 |
| K03 | 48 |
| K04 | 64 |
| K05 | 80 |
| K06 | 96 |
| K07 | 112 |
| K08 | 128 |
| K09 | 143 |
| K10 | 159 |
| K11 | 175 |
| K12 | 191 |
| K13 | 207 |
| K14 | 223 |
| K15 | 239 |
| K16 | 255 |

FIG. 5B

| PATCH | TONE LEVEL | MEASURED AVERAGE READ VALUE |
|---|---|---|
| K00 | 0 | 250 |
| K01 | 16 | 207 |
| K02 | 32 | 191 |
| K03 | 48 | 166 |
| K04 | 64 | 141 |
| K05 | 80 | 109 |
| K06 | 96 | 100 |
| K07 | 112 | 88 |
| K08 | 128 | 75 |
| K09 | 143 | 64 |
| K10 | 159 | 51 |
| K11 | 175 | 45 |
| K12 | 191 | 32 |
| K13 | 207 | 29 |
| K14 | 223 | 24 |
| K15 | 239 | 21 |
| K16 | 255 | 20 |

FIG. 5C

| TONE LEVEL | TARGET READ VALUE |
|---|---|
| 0 | 250 |
| 17 | 225 |
| 34 | 200 |
| 51 | 175 |
| 68 | 150 |
| 85 | 130 |
| 102 | 110 |
| 119 | 90 |
| 136 | 75 |
| 153 | 60 |
| 170 | 50 |
| 187 | 42 |
| 204 | 35 |
| 221 | 30 |
| 238 | 24 |
| 255 | 20 |

IMAGE OUTPUT DEVICE, IMAGE OUTPUT METHOD, AND COMPUTER PROGRAM PRODUCT

CROSS-REFERENCE TO RELATED APPLICATIONS

The present application claims priority to and incorporates by reference the entire contents of Japanese Patent Application No. 2009-295338 filed in Japan on Dec. 25, 2009 and Japanese Patent Application No. 2010-265461 filed in Japan on Nov. 29, 2010.

BACKGROUND OF THE INVENTION

1. Field of the Invention

The present invention relates to an image output device, an image output method, and a computer program product.

2. Description of the Related Art

In an image output device, even if the same image data is output, the density of output images may vary due to time degradation of a developing material; therefore, for the purpose of suppressing a temporal variation in density, the image output device outputs a predetermined patch and causes a scanner or the like to read the patch, thereby perceiving tone characteristics at the time, and generates a tone correction parameter.

In such an image output device, however, the density may still vary according to locations within output images that are based on the same image data. This occurs due to the quality of a member or the assembly accuracy, for example, in an electrophotographic image output device, due to the eccentricities of a photosensitive element and a transfer roller or a variation in distance between the photosensitive element and a developing sleeve along a rotating direction of the photosensitive element.

Namely, a photosensitive drum and a developing sleeve have eccentricities which cannot be suppressed in view of the design accuracy, and an interval between them varies according to respective rotation angles, so an amount of color material varies, and the density varies; that is why a density variation in a rotating direction of the photosensitive drum occurs. In general, a rotation angle of a rotating body including the photosensitive drum is not synchronized with the position of a sheet, so the locations showing the high density and the low density and further the location showing the medium density vary from page to page. Therefore, when the density of a patch is measured only at a specific point on a page, in addition to a temporal density variation, a density variation due to a difference in location caused by the eccentricity of the rotating body, such as the photosensitive drum, is also contained. Consequently, an appropriate tone correction parameter for suppressing the temporal density variation is not obtained.

Conventionally, a parameter is generated using one patch. To cope with the above-mentioned problem, there has been proposed a device that generates a plurality of patches having the same density tone level on a sheet at appropriate intervals in a rotating direction of a photosensitive drum. The device generates a tone correction parameter by averaging values obtained by measuring the densities of the patches, thereby perceiving tone characteristics at the time when the patches are output while suppressing the effect of a phenomenon that the density varies according to locations within images. The device generates a density correction processing parameter for suppressing a temporal density variation (for example, see Japanese Patent Application Laid-open No. 2000-103147, Japanese Patent Application Laid-open No. 2008-209436, and Japanese Patent Application Laid-open No. 2009-38734).

In such conventional technologies, the temporal density variation can be suppressed and images at the constant density can be output; however, they have not assumed the function to change the accuracy of outputting an image at the constant density. Namely, a user cannot arbitrarily set the image output accuracy, and an image with an image output accuracy which the user desires cannot be output.

SUMMARY OF THE INVENTION

It is an object of the present invention to at least partially solve the problems in the conventional technology.

An image output device according to an aspect of the present invention includes: a storage unit that preliminarily stores therein an optimum interval of a plurality of patches having the same color and tone and formed on a sheet at which an average density value of the patches is stabilized; an input unit that receives an input of a condition for arrangement of the patches from a user; a layout deriving unit that determines arrangement of the patches on the sheet on the basis of the input condition for arrangement and the optimum interval; and an output unit that outputs the patches onto the sheet in the determined arrangement.

An image output method according to another aspect of the present invention executed by an image output device, the image output device including a storage unit that preliminarily stores therein an optimum interval of a plurality of patches having the same color and tone and formed on a sheet at which an average density value of the patches is stabilized, includes: receiving an input of a condition for arrangement of the patches from a user; determining arrangement of the patches on the sheet on the basis of the input condition for arrangement and the optimum interval; and outputting the patches onto the sheet in the determined arrangement.

A computer program product according to still another aspect of the invention includes a non-transitory computer-usable medium having computer-readable program codes embodied in the medium and executed by a computer, the computer including a storage unit that preliminarily stores therein an optimum interval of a plurality of patches having the same color and tone and formed on a sheet at which an average density value of the patches is stabilized, the program codes when executed causing the computer to execute: receiving an input of a condition for arrangement of the patches from a user; determining arrangement of the patches on the sheet on the basis of the input condition for arrangement and the optimum interval; and outputting the patches onto the sheet in the determined arrangement.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5B is a diagram showing measured average read values;

FIG. 5C is a diagram showing target read levels;

DETAILED DESCRIPTION OF THE PREFERRED EMBODIMENTS

Exemplary embodiments of an image output device, an image output method, and a computer program product according to the present invention are explained in detail below with reference to the accompanying drawings. Incidentally, the embodiments are described below taking a printer to which the image output device is applied as an example.

First Embodiment

Figure 1:
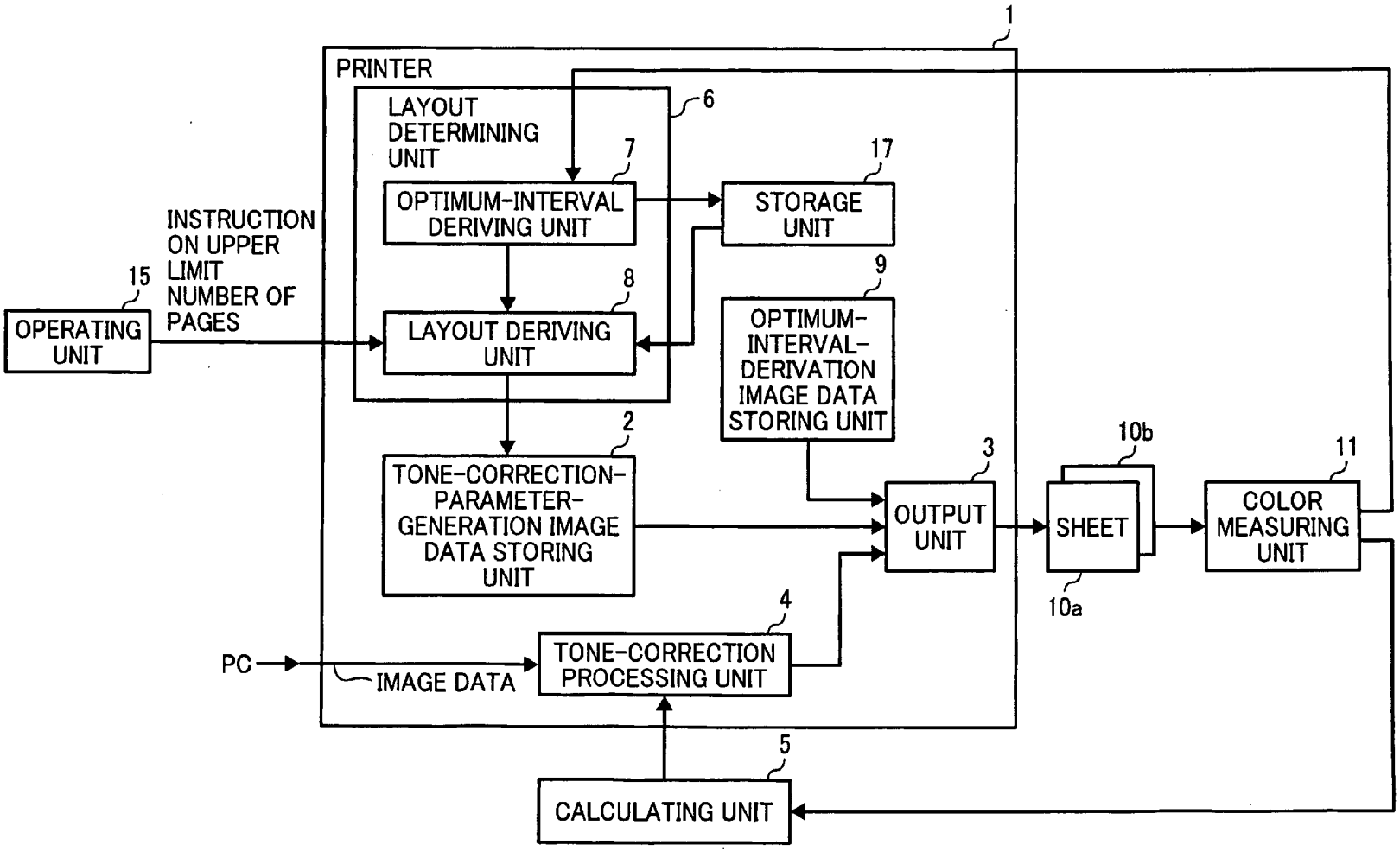
FIG. 1 is a block diagram showing a functional configuration of a printer according to a first embodiment.

FIG. 1 is a block diagram showing a functional configuration of a printer according to a first embodiment. As shown in FIG. 1, a printer 1 according to the present embodiment is connected to a personal computer (PC) and a color measuring unit 11. The color measuring unit 11 reads patches formed on a sheet 10*a* for tone correction parameter generation and a sheet 10*b* for optimum interval derivation, and corresponds to, for example, a scanner.

The printer 1 according to the present embodiment mainly includes a tone-correction-parameter-generation image data storing unit 2, an output unit 3, a tone-correction processing unit 4, a calculating unit 5, a layout determining unit 6, an optimum-interval-derivation image data storing unit 9, an operating unit 15, and a storage unit 17.

The tone-correction-parameter-generation image data storing unit 2 is a storage, medium, such as a hard disk drive (HDD) or a memory, for storing therein image data for tone correction parameter generation. The optimum-interval-derivation image data storing unit 9 is a storage medium, such as an HDD or a memory, for storing therein image data for optimum interval derivation. The storage unit 17 is a storage medium, such as an HDD or a memory, for storing therein an optimum interval of patches.

The output unit 3 includes a photosensitive drum and the like. The output unit 3 forms various images on a sheet, which is a recording medium, and outputs the sheet.

The tone-correction processing unit 4 corrects a tone of image data input from the PC or the like using a gamma correction table. The calculating unit 5 generates the gamma correction table on the basis of read values of patches.

The operating unit 15 receives an instruction on the upper limit number of pages of sheets, on which a plurality of patches are arranged, as a condition for arrangement of the plurality of patches from a user.

The layout determining unit 6 determines arrangement of the plurality of patches on the sheet. As shown in FIG. 1, the layout determining unit 6 includes an optimum-interval deriving unit 7 and a layout deriving unit 8.

The optimum-interval deriving unit 7 receives image data generated by the color measuring unit 11 by reading a sheet 10*b* onto which the image data for optimum interval derivation is output, and obtains an optimum interval of patches, and then stores the obtained optimum interval in the storage unit 17. The layout deriving unit 8 determines arrangement of patches on a sheet 10*a* for tone correction parameter generation so as to form the patches within the upper limit number of pages instructed through the operating unit 15.

Hereinafter, image data is expressed by a tone level, i.e., an integer of 0 or greater but not exceeding 255; the higher the level, the higher the density. On the other hand, the smaller the scanner data, i.e., the scanner read value, the darker the color.

Figure 2:
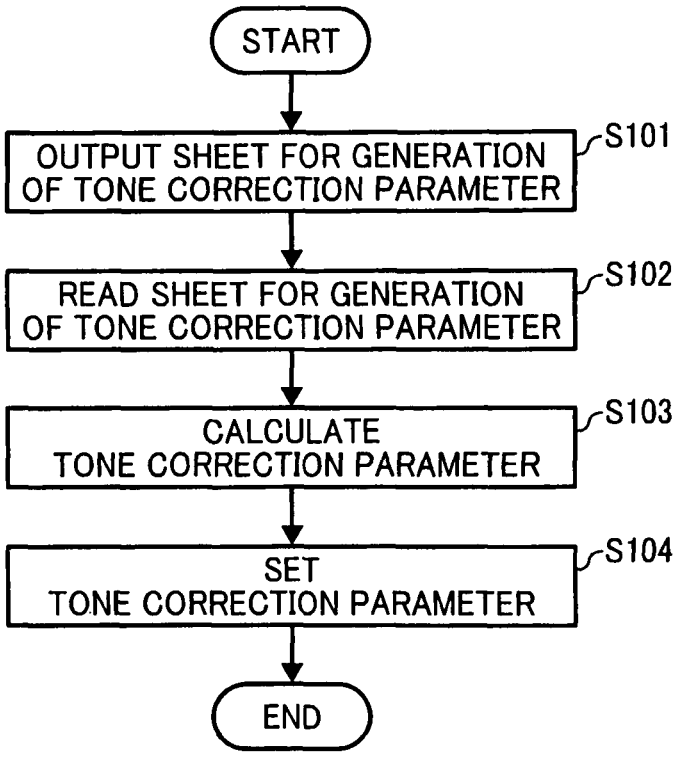
FIG. 2 is a flowchart showing a procedure of a tone-correction-parameter generating process according to the first embodiment.

FIG. 2 is a flowchart showing a procedure of a tone-correction-parameter generating process according to the first embodiment. At Step S101, the output unit 3 receives image data for tone correction parameter generation to be described below, and forms on a sheet 10*a* for tone correction parameter generation as shown in FIG. 3 a patch set K201, a patch set C202, a patch set Y203, a patch set M204, a patch set K211, a patch set C212, a patch set Y213, and a patch set M214 as well as an explanatory text 231 for a user, and then outputs the sheet 10*a* with the patch set K201 being at the lead in a rotating direction of the photosensitive drum.

Alphabets "K", "C", "Y", and "M" here denote black color, cyan color, yellow color, and magenta color, respectively; these colors are all solid color of the image output device, i.e., color represented by a single color material.

Figure 3:
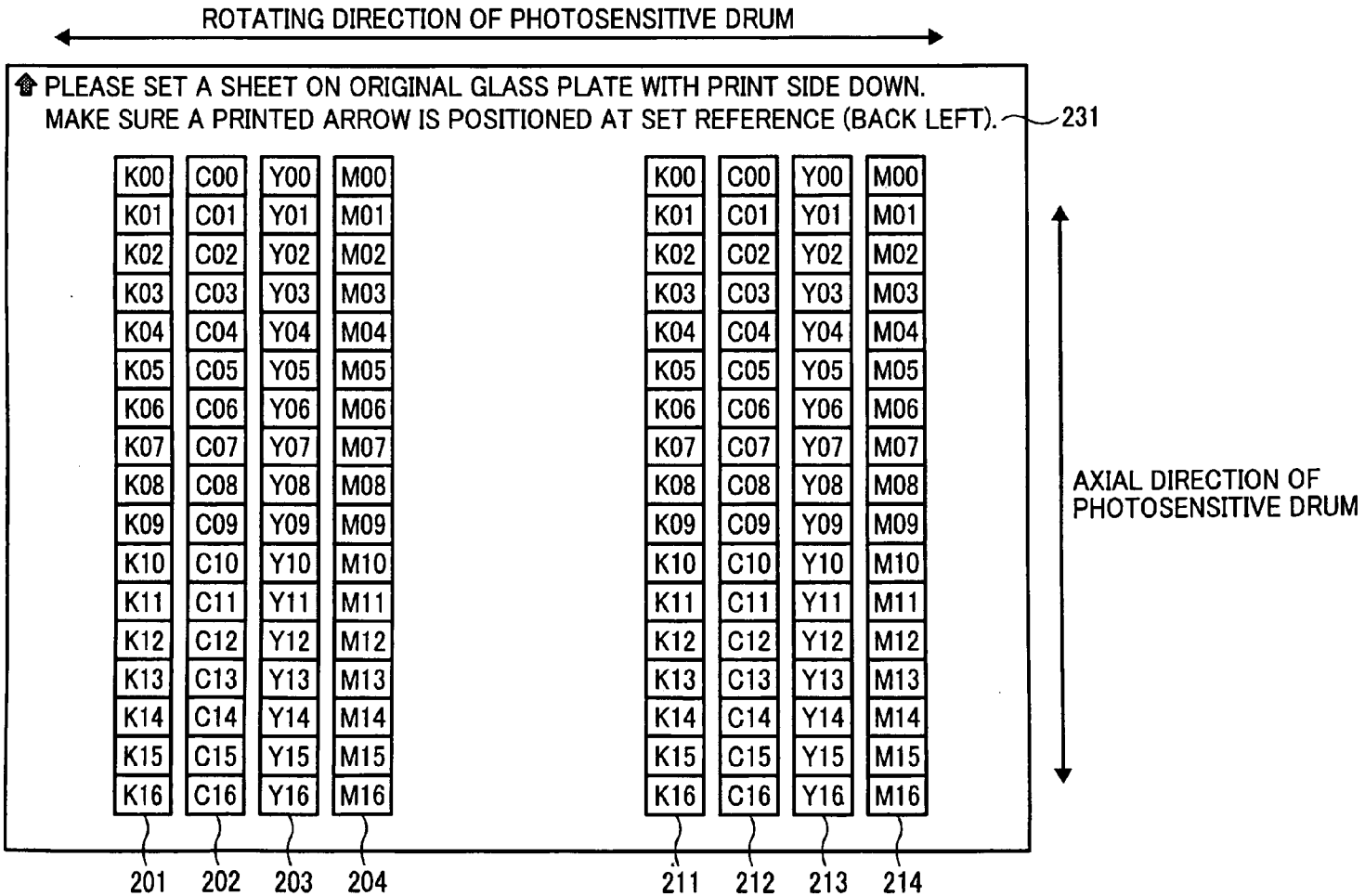
FIG. 3 is a schematic diagram showing an example of a sheet for tone correction parameter generation.
Figures 4, 5A:
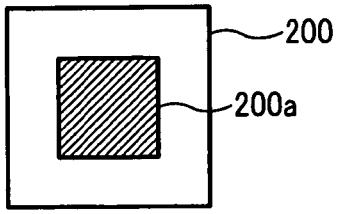
FIG. 4 is an explanatory diagram showing a method to calculate a read value on a patch-by-patch basis.
FIG. 5A is a diagram showing tone levels of K-color patches.

FIG. 3 is a schematic diagram showing an example of the sheet 10*a* for tone correction parameter generation. As shown in FIG. 3, the patch set K201 and the patch set K211 of the sheet 10*a* for tone correction parameter generation are each composed of patches K00, K01, . . . , K16. As shown in FIG. 5A, the patch K00 is provided with a K tone level of 0, the patch K16 is provided with a K tone level of 255, and the other patches K01 to K15 are provided with K tone levels which are increased almost equally with increasing patch number; C, M, and Y tone levels are all zero.

The tone levels of the patches K00 to K16 are not necessarily increased almost equally with increasing patch number; for example, the tone levels can be increased in such a manner that a difference between the tone levels is widened with increasing tone level. The important point is that respective patches Kn ($0 \le n \le 16$) of the patch sets K201 and K211 have the same tone level. By performing a process to be described below, the patch set K201 and the patch set K211 are spaced at an optimum interval d.

Similarly, for example, the patch set C202 and the patch set C212 are each composed of patches C00, C01, . . . , C16. The patch C00 is provided with a C tone level of 0, the patch C16 is provided with a C tone level of 255, and the other patches C01 to C15 are provided with C tone levels which are increased almost equally with increasing patch number; K, M, and Y tone levels are all zero.

In the present embodiment, a space is provided between the patch sets, for example, between the patch set K201 and the patch set C202; alternatively, the patch sets can be arranged without any space between them. Furthermore, a space can be provided between the patches in each patch set, for example, between the patches K08 and K09 in the patch set K201, or the patches in each patch set can be arranged without any space between them as in the present embodiment.

Incidentally, on the sheet for tone correction parameter generation shown in FIG. 3, given tone levels are directly output. Alternatively, a tone correction parameter previously generated by the present image output device may be used after being subjected to a tone correction process.

To return to FIG. 2, at next Step S102, the color measuring unit (the scanner) 11 reads the above-described sheet 10*a* for tone correction parameter generation, which is set on the color measuring unit (the scanner) 11 by a user, and calculates a read value on a patch-by-patch basis.

FIG. 4 is an explanatory diagram showing a method to calculate a read value on a patch-by-patch basis. The color measuring unit (the scanner) 11 reads the sheet 10*a* for tone correction parameter generation, and provides a read value to each patch as follows.

Data of a green channel of the scanner is used with respect to the K and Y patches, data of a red channel of the scanner is used with respect to the C patch, and data of a blue channel of the scanner is used with respect to the M patch. An average value of 128×128 pixels located within each patch in each data is obtained as a read value of the patch. With respect to each color patch, a channel in which data of the scanner varies over a wide range is selected.

As shown in FIG. 4, with respect to one patch 200, an average value of scanner data of the predetermined channel in a patch read value calculating target area 200*a* of the above-described size is a read value.

To return to FIG. 2, at next Step S103, the calculating unit 5 derives a tone correction parameter. A method to derive the tone correction parameter is explained with reference to FIGS. 5B and 5C. There exist two patches output at the same color and tone level. For example, K tone levels of the patch K08 in the patch set K201 and the patch K08 in the patch set K211 are both 128 as shown in FIG. 5A. At Step S102, a read value is calculated with respect to each patch.

A read value of the K tone level of 128 corresponding to the patch K08 is set to be an average value of the respective read values of the patches K08 in the patch sets K201 and K211. For example, when the read value of the former patch is 80 and the read value of the latter patch is 70, a read value of the K tone level of 128 is set to 75 which is an average value of the two. In this manner, measured average read values shown in FIG. 5B are obtained. Incidentally, also in the case where there exist three or more patches output at the same color and tone level, an average value is calculated similarly to the above.

Then, a gamma correction table, which is a tone correction parameter, is generated so as to meet a relation between a tone level preliminarily provided as a target and a read value of each patch.

FIG. 5C shows a relation between target tone level and read value. When the image output device is instructed to output, for example, a patch of a tone level of 136, such a density that a scanner read value is 75 is expected, and it is necessary to generate a gamma correction table capable of obtaining this density characteristic.

Figure 6A:
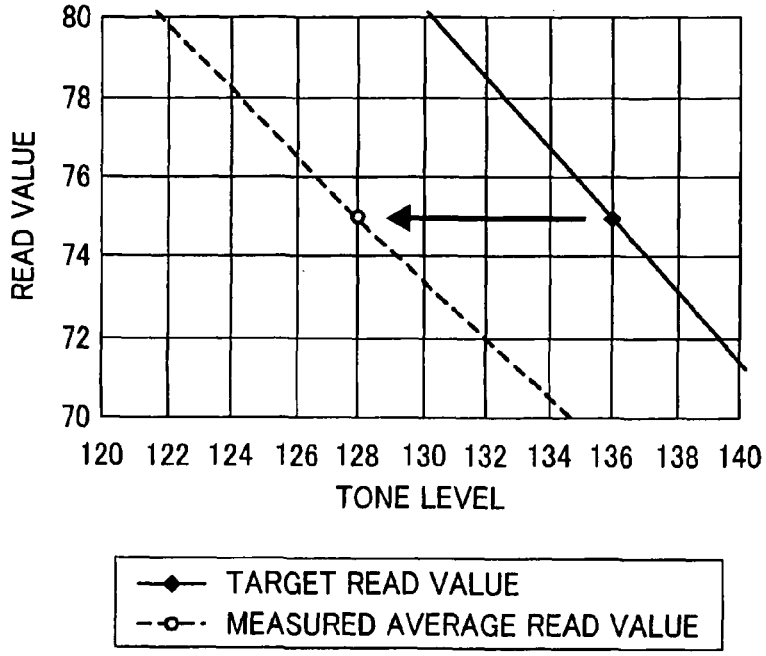
FIG. 6A is a diagram showing a gamma correction table.

In the case where the read value with respect to the tone level of 136 is given 75 as a target as shown in FIG. 5C, and the read value of the patch in the K tone level of 125 is 75 as shown in FIG. 5B, when the tone level of 136 is input, such a gamma correction table that a tone level of 128 is output as shown in FIG. 6A is generated.

Namely, data of the K tone level of 136 is converted into the tone level of 128 by the tone correction process and output. In a result of the output of the sheet 10*a* for tone correction parameter generation shown in FIG. 3, a read value corresponding to a patch output at the K tone level of 128 is 75 as shown in FIG. 5B, so by performing a tone correction process using the gamma correction table generated as described above, it can be expected to obtain a target output, i.e., a read value of 75 with respect to the tone level of 136.

Incidentally, in the case where a read value of 30 is given as a target with respect to a tone level of 221 as shown in FIG. 5C, there exists no patch of which the read value is 30 as shown in FIG. 5B. In this case, a tone level corresponding to the read value of 30 is calculated by linear interpolation.

Figure 6B:
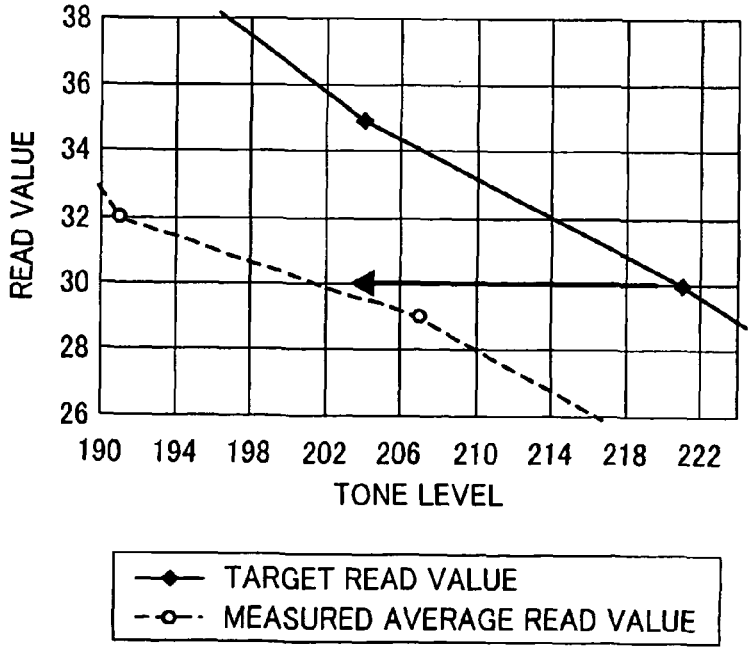
FIG. 6B is a diagram showing a gamma correction table.

In FIG. 5B, a read value of the patch K12, i.e., the patch at the K tone level of 191 is 32, and a read value of the patch K13, i.e., the patch at the K tone level of 207 is 29, so a tone level corresponding to the read value of 30 shall be 202, which a value obtained by $[(207-191)/(29-32)]\times(30-32)+191\approx201.66$ is rounded off to the whole number (see FIG. 6B).

In this way, after the gamma correction table for the tone levels at 16 discrete points shown in FIG. 50 is generated, the 16 points are smoothed by spline interpolation and adjusted so as not to trade places if needed, and a gamma correction table defining output tone levels corresponding to level-to-level input tone levels from 0 to 255 is generated.

Incidentally, in the present embodiment, it is configured that output patches are read by the scanner. Namely, instead of a colorimeter, such as a density meter or a brightness meter, the scanner is used to perceive tone characteristics. Therefore, in the present embodiment, the desired density or brightness of an image when output at a certain tone level is preliminarily converted into a scanner read value as a target, thereby providing the relation between tone level and read value as shown in FIG. 5C.

This is, for example, in a copier, a preferred example to perceive tone characteristics without providing a colorimeter separately because the copier has a printer for outputting an image and a scanner for inputting an image; however, also in the copier, it can be configured that not the scanner but a colorimeter, such as a density meter or a brightness meter, is used to perceive tone characteristics. In this case, a gamma correction table is generated using a target indicating a relation between each tone level and the density, the brightness, or the like instead of a target indicated in the relation with a scanner read value corresponding to each tone level shown in FIG. 5C.

To return to FIG. 2, at next Step S104, the tone-correction processing unit 4 of the printer 1 is set to use the tone correction parameter (the gamma correction table) in tone processing.

Figure 7:
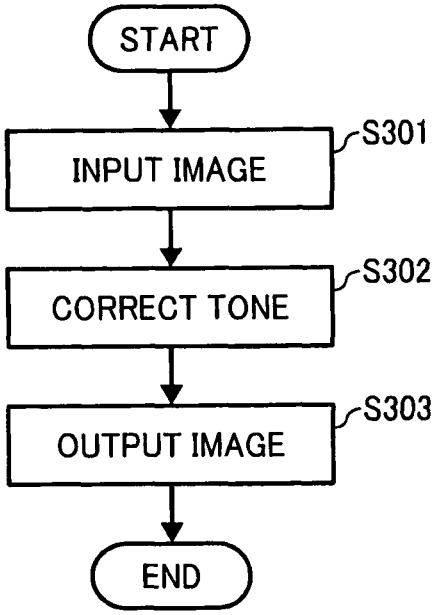
FIG. 7 is a flowchart showing a procedure of a tone correction process.

FIG. 7 is a flowchart showing a procedure of a tone correction process using the gamma correction table, which is the tone correction parameter, generated as described above.

At Step S301, image data having an integer of 0 or greater but not exceeding 255 pixel by pixel from the PC is input to the tone-correction processing unit 4 of the printer 1 on a pixel-by-pixel basis. At Step S302, the tone-correction processing unit 4 performs a tone correction of the received image by converting a tone level of the received image on a pixel-by-pixel basis using the gamma correction table. At Step S303, the output unit 3 outputs a per-pixel image at the converted tone level.

Figure 8:
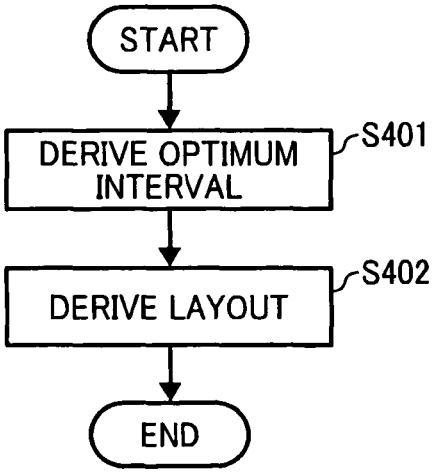
FIG. 8 is a flowchart showing a procedure of a layout determining process.

FIG. 8 is a flowchart showing a procedure of a process for generating image data for tone correction parameter generation, i.e., a layout determining process for determining arrangement of patches.

Figure 9A:
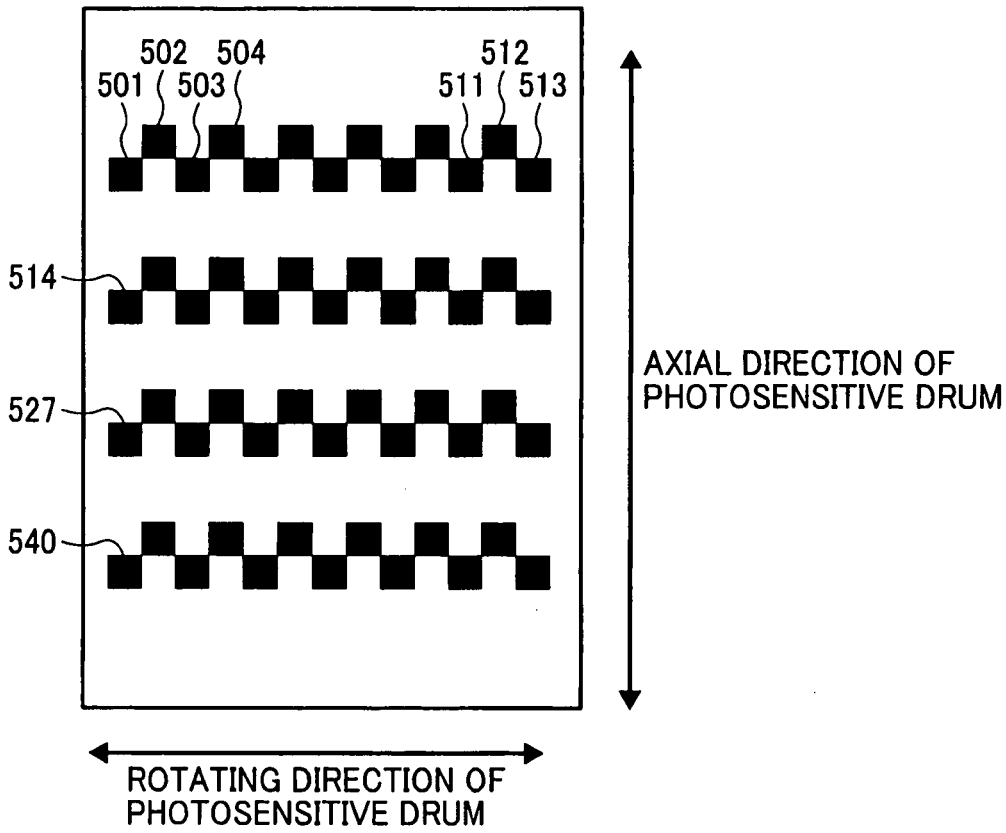
FIG. 9A is a schematic diagram showing an example of an image pattern for optimum interval derivation.

To determine the layout, at Step S401, the output unit 3 acquires an image pattern for optimum interval derivation shown in FIG. 9A from the optimum-interval-derivation image data storing unit 9 and outputs the image pattern onto a sheet 10*b* for optimum interval derivation; the color measuring unit (a density meter) 11 measures the density of the sheet 10*b* for optimum interval derivation; the optimum-interval deriving unit 7 perceives a relation between patch location and density and derives an optimum interval.

Figure 10A:
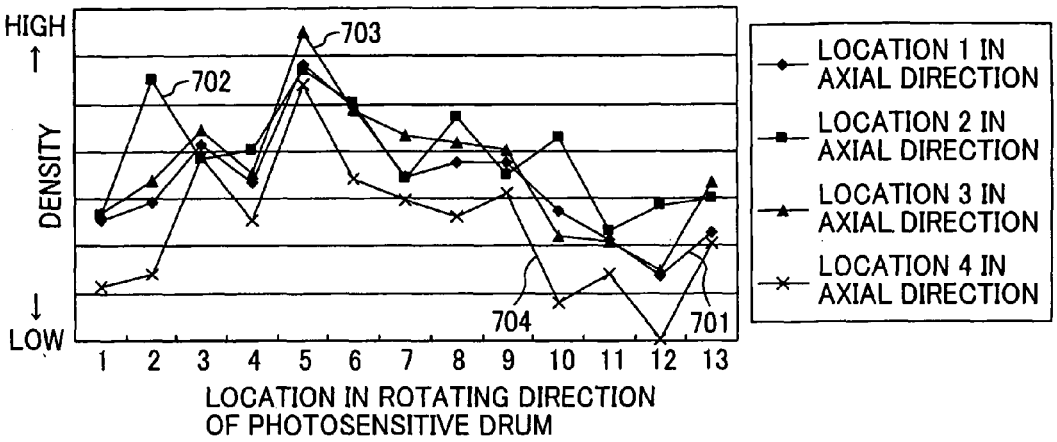
FIG. 10A is a diagram showing a density distribution on the first page when the image pattern for optimum interval derivation is output.
Figure 10B:
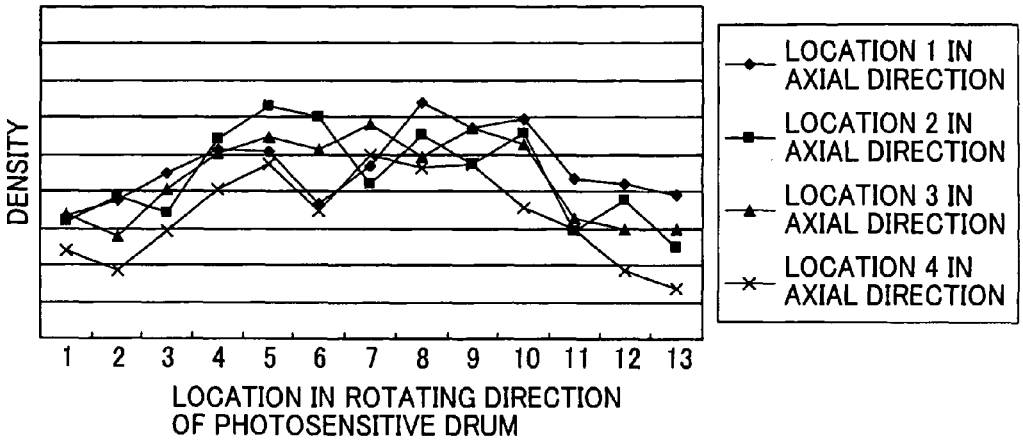
FIG. 10B is a diagram showing a density distribution on the second page when the image pattern for optimum interval derivation is output.
Figure 10C:
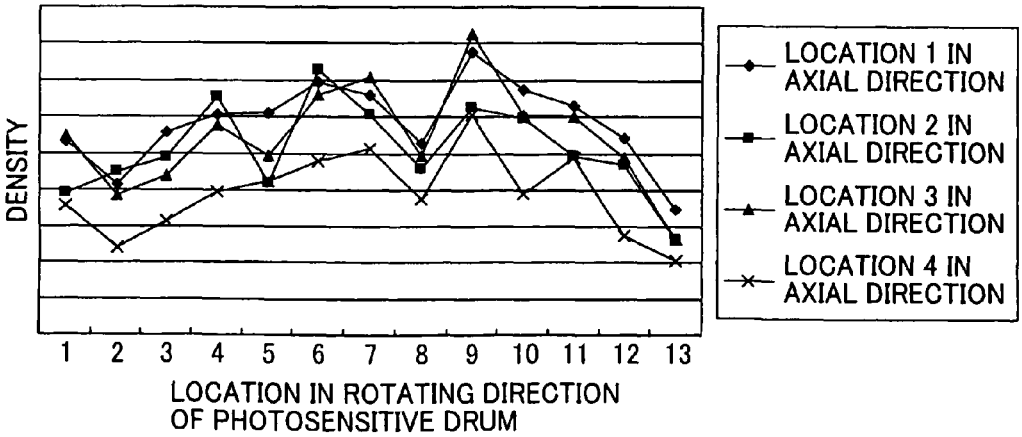
FIG. 10C is a diagram showing a density distribution on the third page when the image pattern for optimum interval derivation is output.

The image pattern shown in FIG. 9A, i.e., the image pattern in which a plurality of the same tone patches are arranged is continuously output onto three pages of sheets by the printer (the image output device) 1, and FIGS. 10A to 10C show results of the measurement of the densities of the image patterns on the three pages by the color measuring unit (the density meter) 11, respectively.

The image pattern shown in FIG. 9A is a pattern in which 15-millimeter-square patches at a tone level of 170 are arranged in an array of 13 locations in a horizontal direction and 8 locations in a vertical direction, and is output such that a patch 501 and a patch 514 are at the lead. Like the patch 501 and a patch 502, the obliquely-adjoining patches are assumed to be the same in location in the axial direction of the photosensitive drum. Namely, the image pattern shown in FIG. 9A is assumed to be a pattern in which patches are arranged at 13 different locations in the rotating direction of the photosensitive drum and 4 different locations in the axial direction of the photosensitive drum. Then, the location in the axial direction of the photosensitive drum of the patch 501 and patches of which the location in the axial direction of the photosensitive drum is the same as the patch 501, such as the patch 502 and the patch 513, is assigned 1 as a location number in the axial direction of the photosensitive drum; the location in the axial direction of the photosensitive drum of the patch 514 and patches of which the location in the axial direction of the photosensitive drum is the same as the patch 514 is assigned 2; the locations in the axial direction of the photosensitive drum of the other patches are assigned location numbers sequentially similarly to the above. A difference of one in the location number in the axial direction of the photosensitive drum represents an interval of 60 millimeters.

Similarly, the location in the rotating direction of the photosensitive drum of the patch 501 and patches of which the location in the rotating direction of the photosensitive drum is the same as the patch 501, such as the patch 514 and a patch 527, is assigned 1 as a location number in the rotating direction of the photosensitive drum; the location in the rotating direction of the photosensitive drum of the patch 502 and patches of which the location in the rotating direction of the photosensitive drum is the same as the patch 502 is assigned 2; the locations in the rotating direction of the photosensitive drum of the other patches are assigned location numbers sequentially similarly to the above. A difference of one in the location number in the rotating direction of the photosensitive drum represents an interval of 15 millimeters.

FIG. 10A is a density distribution on the first page, and a density distribution 701 at the location 1 in the axial direction of the photosensitive drum shows that the density varies according to the location in the rotating direction of the photosensitive drum on the horizontal axis of the graph. Namely, the density is high at the location 5 in the rotating direction of the photosensitive drum and low at the location 12 in the rotating direction of the photosensitive drum.

Furthermore, about the same is true of a density distribution 702 at the location 2 in the axial direction of the photosensitive drum, a density distribution 703 at the location 3 in the axial direction of the photosensitive drum, and a density distribution 704 at the location 4 in the axial direction of the photosensitive drum. That is, the density is high at the location 5 in the rotating direction of the photosensitive drum and low at the location 12 in the rotating direction of the photosensitive drum.

FIG. 10B is a density distribution on the second page, and FIG. 10C is a density distribution on the third page. In the both cases, the density varies according to the location in the rotating direction of the photosensitive drum; however, the locations indicating the high density and the low density are different from each other.

One of reasons why such a density variation according to the location in the rotating direction of the photosensitive drum occurs is the eccentricity of a rotating body, such as the photosensitive drum.

Figure 9B:
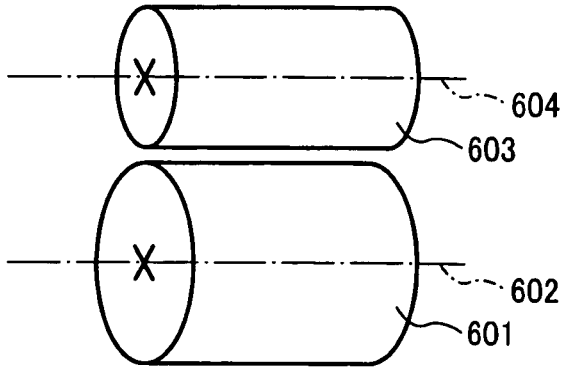
FIG. 9B is a diagram showing a relation between a photosensitive drum and a developing sleeve of the printer.

FIG. 9B shows a relation between a photosensitive drum 601 and a developing sleeve 603 of the printer 1. The photosensitive drum 601 and the developing sleeve 603 are placed slightly apart so that an axis 602 of the photosensitive drum and an axis 604 of the developing sleeve are parallel to each other.

However, as described above, the photosensitive drum 601 and the developing sleeve 603 both have the eccentricities which cannot be suppressed in view of the design accuracy, and this causes a density variation in the rotating direction of the photosensitive drum as shown in FIGS. 10A to 10C; as a result, an appropriate tone correction parameter for suppressing a temporal density variation cannot be obtained.

To suppress the effect of the density variation in the rotating direction of the photosensitive drum, measured values of densities of a plurality of patches spaced at appropriate intervals in the direction are averaged, thereby making it possible to obtain a stable value. Consequently, an optimum interval at which an average value of measured density values is most stabilized is obtained.

The stabilizing interval is obtained in such a manner that the image pattern shown in FIG. 9A is continuously output onto a few pages of sheets, for example, three pages of sheets, and average density values between multiple pairs of the same tone patches spaced at a certain interval are obtained, and the interval at which the low dispersion is seen is employed. Alternatively, the stabilizing interval can be obtained in such a manner that average density values between multiple pairs of the same tone patches spaced at a certain interval are obtained, and the interval at which the mean square of a difference from an average density value of all the same tone patches output is small is employed.

Furthermore, the interval at which an average density value is stabilized is not limited to an interval in the rotating direction of the photosensitive drum; alternatively, the interval can be two-dimensionally obtained. Moreover, to obtain the interval in the rotating direction of the photosensitive drum at which an average density value is stabilized, an average density of patches of which the location in the axial direction of the photosensitive drum is the same can be used. Namely, the process can be performed with an average density of the patches 501, 514, 527, and 540 shown in FIG. 9A as the density of the location 1 in the rotating direction of the photosensitive drum.

Figure 11:
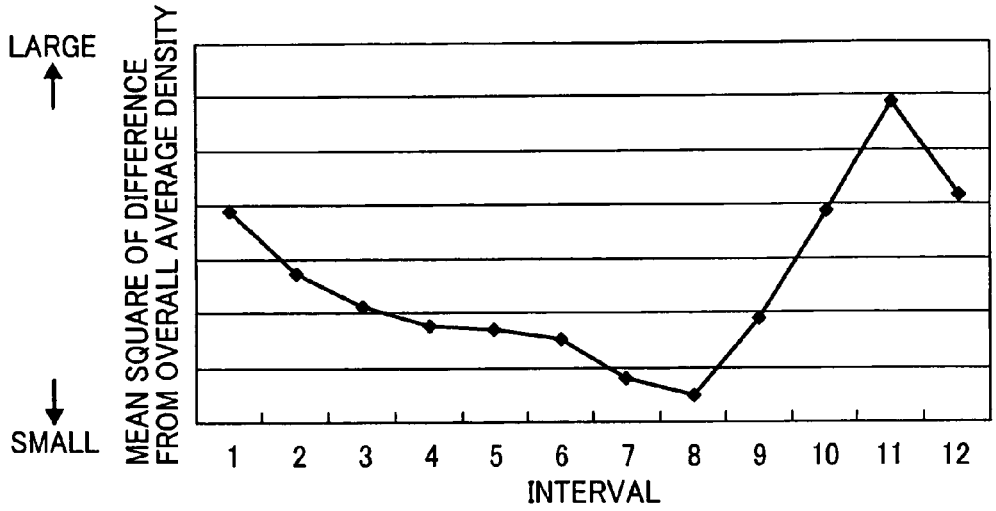
FIG. 11 is a graph showing a relation between intervals of patches in a rotating direction of the photosensitive drum and the mean square of a difference from an average density value of all the patches.

FIG. 11 is a graph showing a relation between intervals of patches in the rotating direction of the photosensitive drum and the mean square of a difference from an average density value of all the patches. To obtain the interval in the rotating direction of the photosensitive drum at which an average density value is stabilized, an average density of patches of which the location in the axial direction of the photosensitive drum is the same is calculated on the basis of the results shown in FIGS. 10A to 10C, and this graph shows the mean square of a difference from an average density value of all the patches on each page at each interval in the rotating direction of the photosensitive drum.

In FIG. 11, the interval on the horizontal axis is indicated by the number of patches; for example, as for the interval 2, an average density value at the locations 1 and 3 in the rotating direction of the photosensitive drum, an average density value at the locations 2 and 4, . . . , an average density value at the locations 11 and 13 are obtained, and the mean square of a difference between each of the obtained average density values and an average density value of all the patches on each page is obtained with respect to each of the three pages.

FIG. 11 shows that the average density value is most stabilized when the interval in the rotating direction of the photosensitive drum is 8, followed by 7, 6, . . . . As described above, a difference of one in the location number corresponds to 15 millimeters, so the intervals 8, 7, and 6 denote intervals of 120 millimeters, 105 millimeters, and 90 millimeters, respectively. Namely, the interval 8 means the same color patches are arranged at a distance of 120 millimeters. The storage unit 17 holds at least information about the interval at which the average density value is most stabilized (for example, in FIG. 11, the interval 8=120 millimeters).

To return to FIG. 8, to determine a layout, at next Step S402, the layout deriving unit 8 derives a layout meeting the upper limit number of pages.

Figure 12:
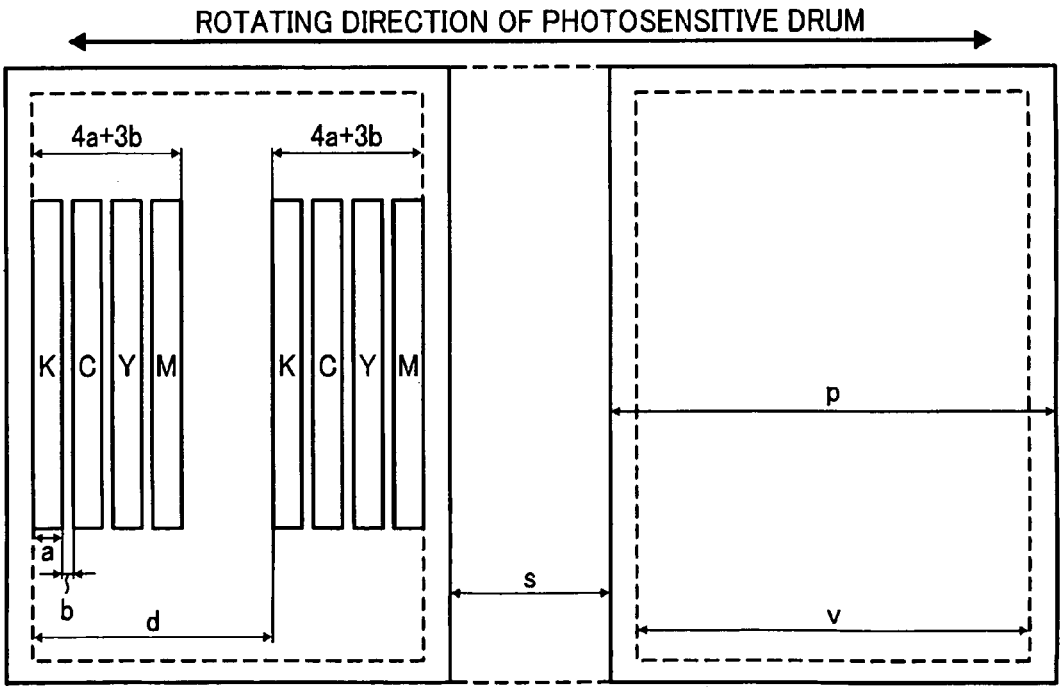
FIG. 12 is a diagram explaining derivation of a layout.

Subsequently, how to derive a layout is explained with reference to FIG. 12. With a focus on only the length in the rotating direction of the photosensitive drum, the length of each patch is denoted by a; an interval between patch sets, such as an interval between the K patch set 201 and the C patch set 202 shown in FIG. 3, is denoted by b or greater; the length of a sheet is denoted by p; the length of an imageable area of one page of sheet is denoted by v; a sheet interval, i.e., an interval between sheets when a plurality of pages of sheets are output is denoted by s.

It is assumed that a user issues an instruction to the printer 1 to output patch sets onto up to two pages of A4 sheets with the long side in the lead and generate a tone correction parameter via the operating unit 15. As described above, the optimum-interval deriving unit 7 preliminarily obtains information about the optimum interval at which an average density value is stabilized, and stores the information in the storage unit 17. The layout deriving unit 8 refers to the information about the optimum interval stored in the storage unit 17 as needed.

Figure 13:
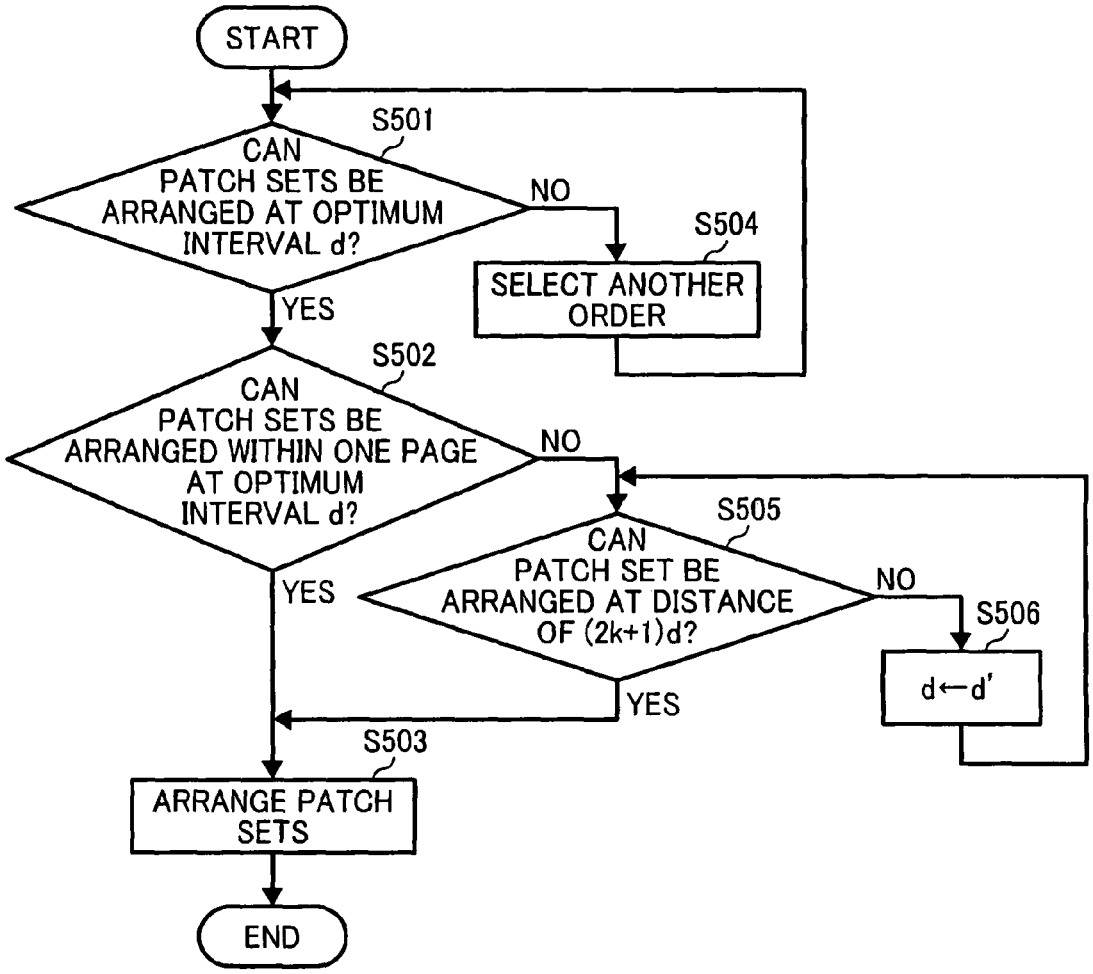
FIG. 13 is a flowchart showing a procedure of a layout deriving process according to the present embodiment.

FIG. 13 is a flowchart showing a procedure of a layout deriving process according to the present embodiment. At Step S501, the layout deriving unit 8 first determines whether patch sets can be arranged at the optimum interval d in the order of KCYMKCYM from the lead in the rotating direction of the photosensitive drum. Specifically, the layout deriving unit 8 determines whether patch sets meet the following relational expression (1) to arrange the same color patch sets at the optimum interval d.

$$(4a+3b)+b\leq d \tag{1}$$

Figure 14:
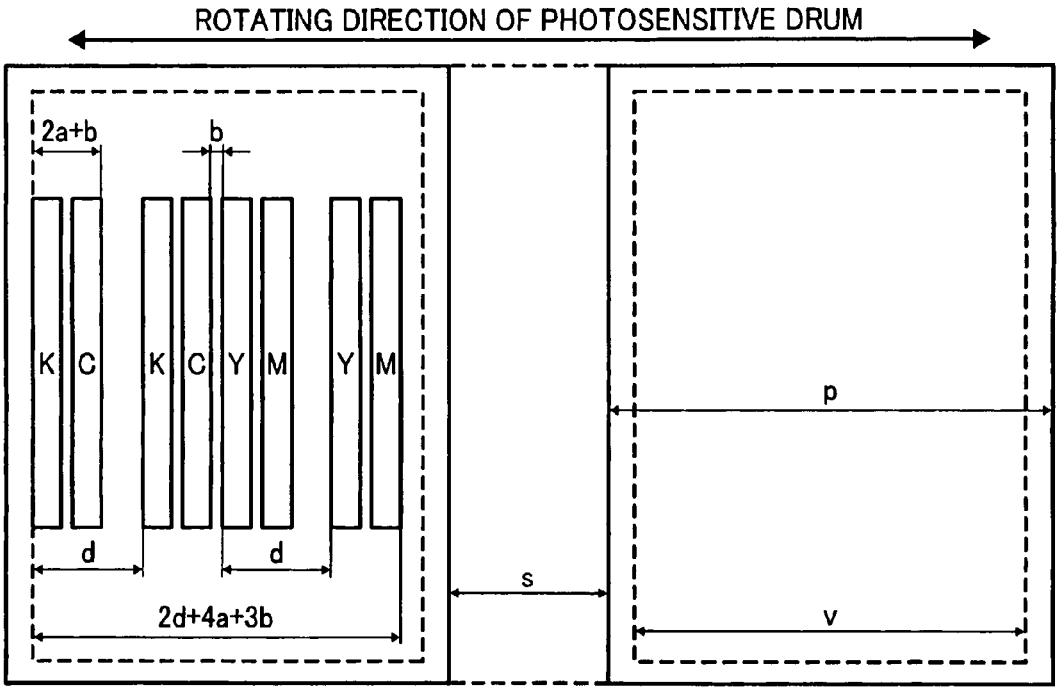
FIG. 14 is a diagram explaining derivation of a layout.

When the patch sets do not meet the expression (1), i.e., when the patch sets cannot be arranged at the optimum interval d in the order of KCYMKCYM from the lead in the rotating direction of the photosensitive drum (NO at Step S501), at Step S504, the layout deriving unit 8 determines whether the patch sets can be arranged in another order. The other orders of the patch sets include, for example, the order of KCKCYMYM from the lead in the rotating direction of the photosensitive drum as shown in FIG. 14 and the order of KKCCMMYY.

At Step S501, when the patch sets meet the expression (1), i.e., when the patch sets can be arranged at the optimum interval d in the order of KCYMKCYM from the lead in the rotating direction of the photosensitive drum (YES at Step S501), at Step S502, the layout deriving unit 8 determines whether the patch sets are formed within one page at the optimum interval d. Specifically, the layout deriving unit 8 determines whether the patch sets meet the following relational expression (2).

$$d+(4a+3b)\leq v \tag{2}$$

When the patch sets meet the expression (2) (YES at Step S502), i.e., when the patch sets meet both conditions of the expressions (1) and (2), at Step S503, the layout deriving unit 8 arranges the patch sets as follows. Namely, the layout deriving unit 8 arranges the K patch set, the C patch set, the Y patch set, and the M patch set in this order from the lead in the rotating direction of the photosensitive drum to be spaced at the interval b between them, and further arranges the K patch set, the C patch set, the Y patch set, and the M patch set in the same order as the first KCYM patch sets to keep the optimum interval d between the first and second K patch sets.

Incidentally, when the patch sets are formed within one page under the condition that the upper limit number of pages is specified to two pages, a layout using only one page can be derived, or the same layout on two pages can be derived. In the latter case, with respect to the same color and tone, an average density value of four patches can be obtained. By using an average density value of many patches, the effect of a sudden or random density variation can be suppressed. Namely, the accuracy can be improved by using many patches.

Furthermore, it can be configured that a patch layout for the first page and a patch layout for the second page are preliminarily stored in the storage unit 17 or the like, and the layout deriving unit 8 selectively uses these layouts as needed.

When it is determined at Step S501 that the patch sets cannot be arranged in the order of KCYMKCYM but can be arranged in the order of KCKCYMYM selected as another order at Step S504 (YES at Step S501), at Step S502, the layout deriving unit 8 determines whether the patch sets meet the following relational expression (3) to form the patch sets within one page as shown in FIG. 14.

$$2d+4a+3b\leq v \tag{3}$$

Then, when it is determined that the patch sets can be arranged in the order of KCYMKCYM (YES at Step S501) but determined at Step S502 that the patch sets cannot be formed on one page at the optimum interval d (NO at Step S502), at Step S505, the layout deriving unit 8 determines whether another K patch set can be arranged at a distance of (2k+1)d from the K patch set on the first page. Here, "k" is an integer of zero or greater.

Specifically, the layout deriving unit 8 determines whether k meeting the following relational expressions (4) and (5) exists.

$$p+s \leq (2k+1)d \quad (4)$$

$$(2k+1)d+(4a+3b) \leq p+s+v \quad (5)$$

Then, when k meeting the expressions (4) and (5) exists (YES at Step S505), at Step S503, the layout deriving unit 8 arranges the patch sets in the layout of forming the patch sets within two pages.

On the other hand, when k meeting the expressions (4) and (5) does not exist (NO at Step S505), i.e., when the patch sets cannot be formed within the upper limit number of pages, two pages at the optimum interval d, the layout deriving unit 8 sets the second optimum interval d' as the optimum interval d (Step S506), and determines whether the patch sets can be formed within two pages at Step S505. Then, when the patch sets cannot be formed within two pages even at the interval d' set as the optimum interval, the layout deriving unit 8 determines the layout of keeping the same color patch sets as far apart as possible within one page.

As described above, in the present embodiment, a tone correction process is performed in such a manner that the upper limit number of pages is specified by a user as a condition for arrangement of a plurality of patches; a layout of arranging patch sets at an the optimum interval so as to form the patch sets within the specified upper limit number of pages is determined; the patch sets in this layout are output onto a sheet; and the sheet is read. Therefore, an image can be output with an image output accuracy which the user desires while suppressing a temporal density variation.

Incidentally, an interval in the rotating direction of the photosensitive drum at which an average density value is stabilized is obtained page by page, so the process can be performed with an average density of the patches 501, 514, 527, and 540 shown in FIG. 9A as the density in the rotating direction of the photosensitive drum.

Incidentally, in the present embodiment, the density meter is used to perceive a state of a density variation of the output result of the pattern shown in FIG. 9A; alternatively, a scanner can be used instead of the density meter. Furthermore, it can be configured that an optimum layout for each page of the upper limit number of pages is preliminarily derived in the same manner as described above, and the preliminarily-derived layout is provided when a user specifies the upper limit number of pages.

Second Embodiment

As shown in FIG. 9B, due to the eccentricity of the photosensitive drum, a variation in density with a cycle of the perimeter of the photosensitive drum is prominent. Consequently, the layout deriving unit 8 in the present embodiment derives a layout in which an interval between the same color patch sets is half the perimeter of the photosensitive drum. Namely, when the perimeter of the photosensitive drum is denoted by L, a layout is derived so as to meet "d=L/2".

In doing so, if a layout in which an interval between the same color patch sets is (2k+1)d cannot be derived within the specified upper limit number of pages, the layout deriving unit 8 derives a layout in which the interval is closest to (2k+1)d.

Incidentally, except the layout deriving unit 8, the configuration and functions of the printer according to the present embodiment are identical to those in the first embodiment.

An image output program executed by the printer 1 according to the first embodiment or the second embodiment is preliminarily built into a ROM or the like.

Alternatively, the image output program executed by the printer 1 according to the first embodiment or the second embodiment can be provided in such a manner that the image output program is recorded on a computer-readable recording medium, such as a CD-ROM, a flexible disk (FD), a CD-R, or a digital versatile disk (DVD), in an installable or executable file format.

Furthermore, the image output program executed by the printer 1 according to the first embodiment or the second embodiment can be provided in such a manner that the image output program is stored on a computer connected to a network, such as the Internet, so that a user can download the image output program via the network. Moreover, the image output program executed by the printer 1 according to the first embodiment or the second embodiment can be provided or distributed via a network, such as the Internet.

The image output program executed by the printer 1 according to the first embodiment or the second embodiment is composed of modules including the above-described units (the output unit 3, the tone-correction processing unit 4, the calculating unit 5, and the layout determining unit 6). As actual hardware, a CPU reads out the image output program from the ROM and executes the image output program, thereby the above units are loaded on a main storage unit, and the output unit 3, the tone-correction processing unit 4, the calculating unit 5, and the layout determining unit 6 are generated on the main storage unit.

Incidentally, in the above embodiments, the image output device is applied to the printer 1 as an example; alternatively, the image output device can be applied to any devices having the printer function, such as an MFP having the printer function.

According to the present invention, it is possible to output an image with an image output accuracy which a user desires while suppressing a temporal density variation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image output device comprising:

a storage unit that preliminarily stores therein an interval of a plurality of patches having the same color and tone and formed on a sheet;

an input unit that receives an input of a condition for arrangement of the patches from a user;

a layout deriving unit that determines arrangement of the patches on the sheet on the basis of the input condition for arrangement and the interval; and an output unit that outputs the patches onto the sheet in the determined arrangement, wherein the input unit receives the upper limit number of pages of the sheets from the user as the condition for arrangement, and the layout deriving unit determines arrangement of the patches on the basis of the interval so as to form the patches within the upper limit number of pages.

2. The image output device according to claim 1, wherein the layout deriving unit determines arrangement of the patches so as to form the patches within the upper limit number of pages and arrange them at the interval as an interval of the patches in a feeding direction of the sheet.

3. The image output device according to claim 1, wherein the layout deriving unit determines arrangement of the patches so as to form the patches within the upper limit number of pages and arrange them at a (2k+1)-fold greater interval than the interval in a feeding direction of the sheet, provided that k is an integer of 0 or greater.

4. The image output device according to claim 1, wherein the layout deriving unit determines arrangement of the patches so as to form the patches within the upper limit number of pages and arrange them at an interval of $(2k+1)L/2$ in a feeding direction of the sheet, provided that k is an integer of 0 or greater and L denotes the perimeter of a photosensitive drum.

5. The image output device according to claim 1, wherein when the patches are output onto different pages of sheets within the upper limit number of pages, the layout deriving unit determines arrangement of the patches such that a distance including an interval between sheets fed is the interval.

6. The image output device according to claim 1, further comprising an optimum-interval deriving unit that drives an optimum interval of the patches at which an average value of densities of the patches measured by a color measuring unit is stabilized and stores the optimum interval in the storage unit as the interval, the color measuring unit reading image data for optimum interval derivation and measuring density of the read image data.

7. The image output device according to claim 6, wherein the color measuring unit further reads the sheet, and the image output device further comprising:

a calculating unit that calculates and generates a density correction processing parameter for outputting an image at constant density on the basis of the read image data; and a tone processing unit that performs tone processing on the basis of the density correction processing parameter.

8. An image output method executed by an image output device, the image output device including a storage unit that preliminarily stores therein an interval of a plurality of patches having the same color and tone and formed on a sheet, the image output method comprising:

receiving an input of a condition for arrangement of the patches from a user;

determining arrangement of the patches on the sheet on the basis of the input condition for arrangement and the interval; and outputting the patches onto the sheet in the determined arrangement, wherein the receiving includes receiving the upper limit number of pages of the sheets from the user as the condition for arrangement, and the determining includes determining arrangement of the patches on the basis of the interval so as to form the patches within the upper limit number of pages.

9. A computer program product comprising a non-transitory computer-usable medium having computer-readable program codes embodied in the medium and executed by a computer, the computer including a storage unit that preliminarily stores therein an interval of a plurality of patches having the same color and tone and formed on a sheet, the program codes when executed causing the computer to execute:

receiving an input of a condition for arrangement of the patches from a user;

determining arrangement of the patches on the sheet on the basis of the input condition for arrangement and the interval; and outputting the patches onto the sheet in the determined arrangement, wherein the receiving includes receiving the upper limit number of pages of the sheets from the user as the condition for arrangement, and the determining includes determining arrangement of the patches on the basis of the interval so as to form the patches within the upper limit number of pages.

10. The image output device according to claim 1, wherein the interval is an optimum interval at which an average density value of the patches is stabilized.

* * * * *